US008104240B2

(12) United States Patent
McCarriston

(10) Patent No.: US 8,104,240 B2
(45) Date of Patent: Jan. 31, 2012

(54) PORTABLE AIR CONDITIONER SUPPORT ARRANGEMENT

(76) Inventor: Allen D. McCarriston, Danvers, MA (US)

( * ) Notice: Subject to any disclaimer, the term of this patent is extended or adjusted under 35 U.S.C. 154(b) by 0 days.

(21) Appl. No.: 13/135,624

(22) Filed: Jul. 11, 2011

(65) Prior Publication Data

US 2011/0272540 A1 Nov. 10, 2011

Related U.S. Application Data

(62) Division of application No. 11/891,521, filed on Aug. 10, 2007, now Pat. No. 7,975,441.

(51) Int. Cl.
*E06B 3/00* (2006.01)

(52) U.S. Cl. ..... 52/204.5; 248/208; 248/214; 62/262; 454/204

(58) Field of Classification Search ..... 248/208, 248/214, 241, 274.1, 288.51, 295.11; 52/204.5; 454/204; 62/262
See application file for complete search history.

(56) References Cited

U.S. PATENT DOCUMENTS

| | | | | |
|---|---|---|---|---|
| 3,134,319 | A * | 5/1964 | Marsteller | 454/203 |
| 4,633,612 | A * | 1/1987 | Forkish | 49/55 |
| 5,636,816 | A * | 6/1997 | Burton et al. | 248/208 |
| 5,967,478 | A * | 10/1999 | Tynes | 248/241 |
| 6,434,789 | B1 * | 8/2002 | Kruse | 16/93 R |
| 6,767,278 | B1 * | 7/2004 | Peterson | 454/196 |
| 6,910,312 | B2 * | 6/2005 | Whitworth | 52/741.3 |
| 7,350,759 | B1 * | 4/2008 | Gray | 248/644 |
| 7,975,441 | B2 * | 7/2011 | McCarriston | 52/204.5 |

* cited by examiner

*Primary Examiner* — Terrell McKinnon
*Assistant Examiner* — Todd M Epps
(74) *Attorney, Agent, or Firm* — Don Halgren

(57) ABSTRACT

A portable air conditioner support arrangement for supporting a portable air conditioner in a window frame assembly. The support arrangement comprises an elongated flange-engaging rail having a first end and a second end, with a channel engaging tab arranged on the first end and the second end of the rail. Each of the tabs are arranged to mate with a channel on the sides of the window frame assembly. The rail has an elongated face to engage a flange on the upper front edge of the air conditioner and maintain the air conditioner free of support by a window sash of the window frame assembly.

2 Claims, 9 Drawing Sheets

PORTABLE AIR CONDITIONER SUPPORT ARRANGEMENT

This invention relates to support arrangements for double hung windows, and more particularly to a "secondary" sill for bracing a window sash and simultaneously supporting an air conditioner within a window frame assembly, and this application is a Divisional application of my application, Ser. No. 11,891,521, filed Aug. 10, 2007, now U.S. Pat. No. 7,975,441, incorporated herein by reference in its entirety.

BACKGROUND OF THE INVENTION

1. Field of the Invention
2. Prior Art

Window installed air conditioners are a common site in many homes of this country. Such portable air conditioners typically rest on the lower window sill, along the lowermost inside edge of the portable air conditioner. Those portable air conditioners have an upwardly directed flange extending along the upper edge of their inner side face. Such an elongated flange is utilized to be supported by and rest against the inside lower edge of a window sash when that window sash is dropped down to support the air conditioner within that window frame. Such an arrangement may cause a mark or scratch and does cause a bias against the lower sash and also makes the lower edge of that window sash bow outwardly. Furthermore, such a "window-defined" enclosure for the portable air conditioner prevents that lower window sash from being opened during times of the year when it is desired to get fresh air in without having to use the "fan portion" of that air conditioner, thus otherwise saving electricity and preventing unnecessary expense.

It would be desirable to be able to support a portable air conditioner within a window frame, wherein that air conditioner may not have to be used in order to get an air flow brought into the room of that window assembly. It would also be desirable to minimize the bending and displacement of a window sash, by the heavy weight of a portable air conditioner, biased thereagainst.

It is therefore an object of the present invention, to overcome the disadvantages of the prior art.

It is a further object of the present invention, to provide a window arrangement to properly support a portable air conditioner within a window frame assembly, while also permitting the window sash therein, to be raised and lowered at will.

It is a still further object of the present invention, to provide a splash shield for such a window frame assembly, when a portable air conditioner is disposed therewithin.

BRIEF SUMMARY OF THE INVENTION

The present invention relates to a window sash support assembly for insertion across a window frame assembly. The support assembly comprises an elongated rail having a first end and a second end. Each first end and second end has a channel engaging block thereon. Each channel engaging block at each end of the support rail is arranged to mate within a window sash channel of the window frame assembly.

When for example, an air conditioning unit is placed within a window frame assembly, the elongated support assembly is placed so as to engage the upwardly directed flange on the front upper edge (on the inside face) of the air conditioner so as to otherwise take the place of the lower frame of the window sash which would otherwise normally bear the brunt of the burden of the air conditioner in place within that window frame assembly.

In a first embodiment of the elongated support assembly, an elongated support rail is arranged having a first end and a second end. The support rail may be extruded, having several block receiving openings extending therethrough, and opened at each end thereof. The support rail has a front air conditioning flange engaging face extending along its entire length.

In this first preferred embodiment, a channel engaging block is adapted to fit within those extruded openings extending through the elongated support rail, and having a window framed channel engaging member extending therefrom. Such a channel engaging block is arranged to be attached to both ends of the elongated support rail. The channel engaging block on each end of the elongated support rail are each mirror images of one another.

In yet a further embodiment of the present invention, such an elongated support assembly comprising the elongated support rail and the engaging blocks at each end thereof may be formed or molded as a single unitary member.

In yet a still further preferred embodiment of the present invention, an elongated support rail may have window channel engaging blocks attached at each end through a bolt or screw thread securement arrangement, avoiding the need for a block receiving opening at each end thereof.

The air conditioning unit bears its weight against the window sill which comprises the original window frame assembly. The elongated support rail assembly, acts as a "secondary" window sash or sill with its front face thereof providing a resistive support to the torque of the heavy portable air conditioner biased thereagainst by its flange located on the upward edge of the inside-facing face of the air conditioner. In such a supportive arrangement, the sash of the window may rest against the upper edge of the elongated rail support. In a further use thereof, that window sash may be lifted, and the portable window engaging air conditioner may still remain, resting safely within the window frame assembly and the elongated rail support. The lower window sash within the window frame assembly, which rests upon the outer edge of the elongated rail, may be raised to "open the window" and allow the portable air conditioner to be inoperative during periods when it is not necessary.

Thus there has been shown a novel support for a portable air conditioner to be disposed within a window frame assembly by an elongated support rail having a window frame channel engaging member at each end thereof, to transfer the burden of the supporting of the air conditioner into the window frame itself, as not being supported and maintained by a window sash lowered against the flange of that air conditioner. Such an arrangement prevents the distortive bowing of that window sash while permitting that window to be opened when desired.

The invention thus comprises a portable air conditioner support arrangement for supporting a portable air conditioner in a window frame assembly. The assembly comprises an elongated flange-engaging rail having a first end and a second end, with a channel engaging block arranged on the first end and the second end of the rail. Each of the blocks are arranged to mate with a channel on the sides of the window frame assembly. The rail has an elongated face to engage a flange on the upper front edge of the air conditioner and maintain the air conditioner free of support by a window sash of the window frame assembly. The channel engaging block on each end of the elongated rail may be formed unitarily with the rail. The channel engaging block on each end of the elongated rail may be attached to the rail by a securement means. The securement means may comprise a threaded member arranged between each of the blocks and their respective ends of the rail. The securement means may also comprise a tab member arranged off of each of the blocks and mating with an opening on their respective ends of the rail. Each of the tab members may also comprise an extension which mates removably and snugly within the channel on the side of the window frame assembly.

The invention may also comprise a method of supporting a portable air conditioner in a window frame assembly, the air conditioner having an elongated, upwardly extending flange along its inwardly facing face. The window frame assembly has a window sash which is slidable vertically in channels in the sides of the window frame assembly, the method comprising one or more of the following steps in this or an alternative order: moving the window sash upwardly to make room for an air conditioner within the window frame assembly; placing the portable air conditioner within a lower portion of the opened window frame assembly; placing an elongated rail having channel-engaging tabs on each end thereof into channels on each side of the window frame assembly, and into biasing sideways support against the flange on the upper front edge of the air conditioner so as to eliminate any force on the window sash by the air conditioner; and moving the sash against and away from an upper surface of the rail without disturbing the air conditioner.

BRIEF DESCRIPTION OF THE DRAWINGS

The objects and advantages of the present invention will become more apparent when viewed in conjunction with the following drawings, in which.

DETAILED DESCRIPTION OF THE PREFERRED EMBODIMENTS

Figure 1:
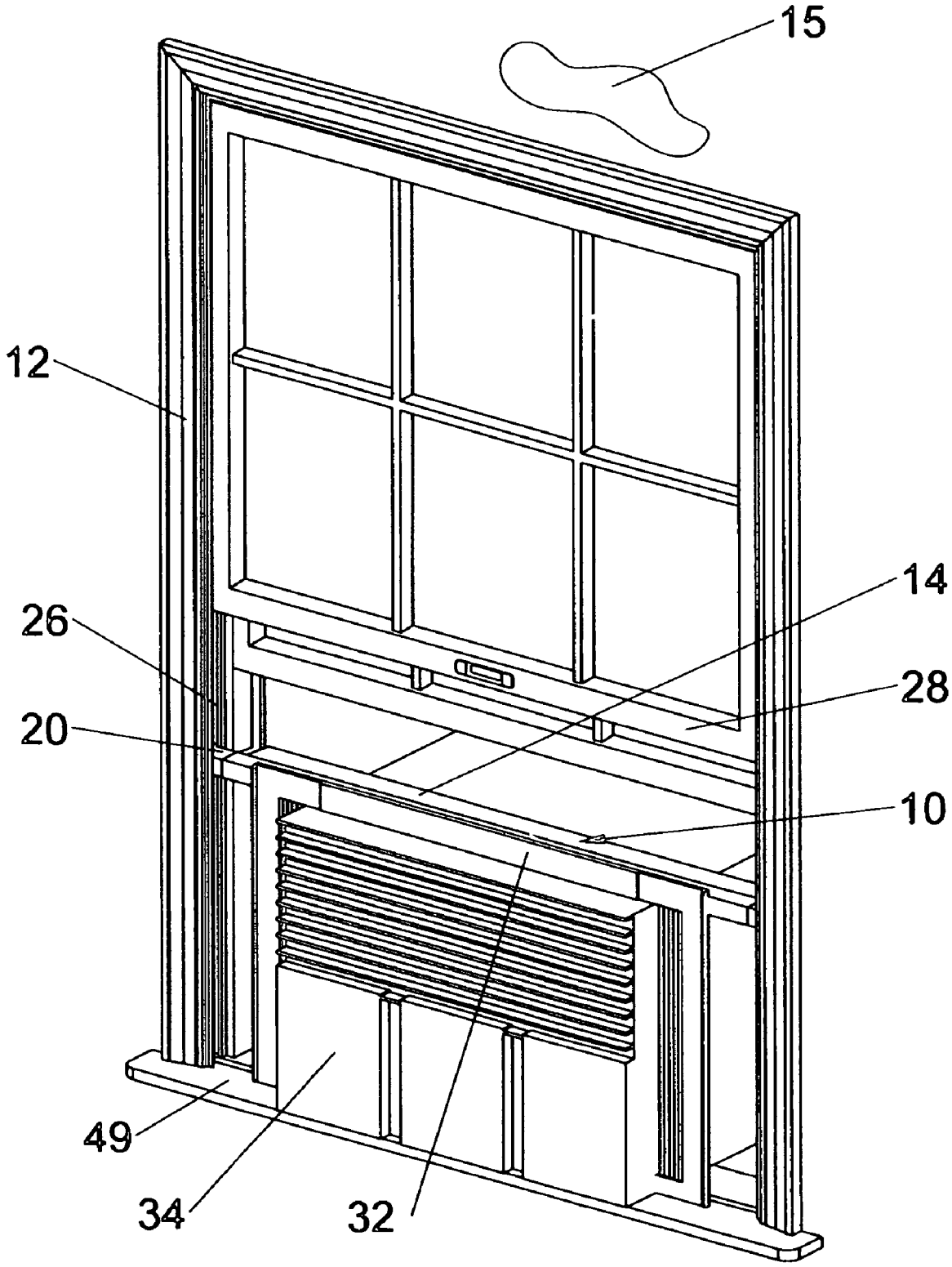
FIG. 1 is a perspective view of a portion of a window frame assembly from the inside of a room where the air conditioning unit disposed therewithin, and that air conditioning unit supported within that window assembly by the support assembly rail of the present invention.
Figure 2:
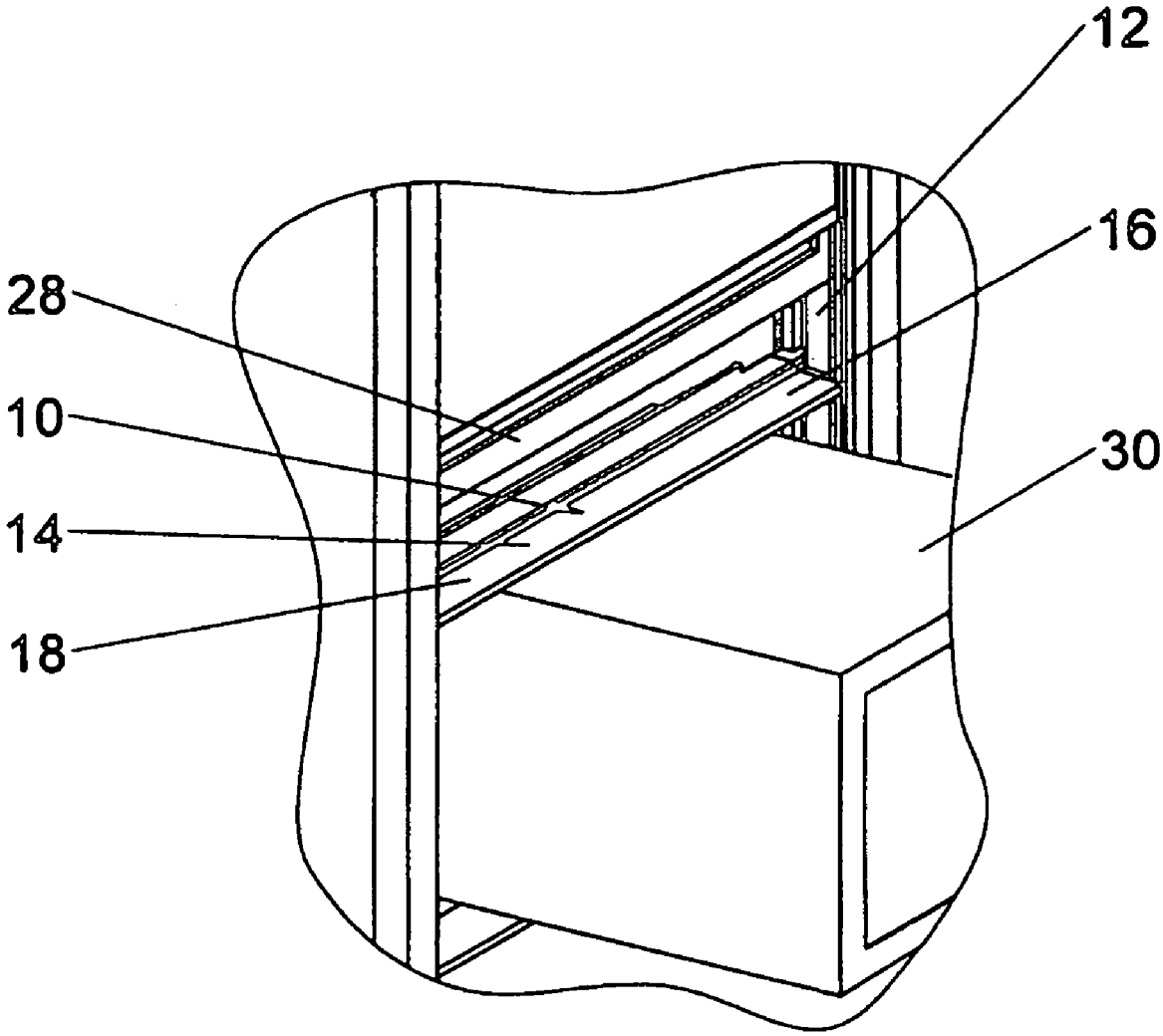
FIG. 2 is a perspective view of that elongated window sash engaging member and air conditioner from an outside view of the window frame represented in FIG. 1.
Figure 3:
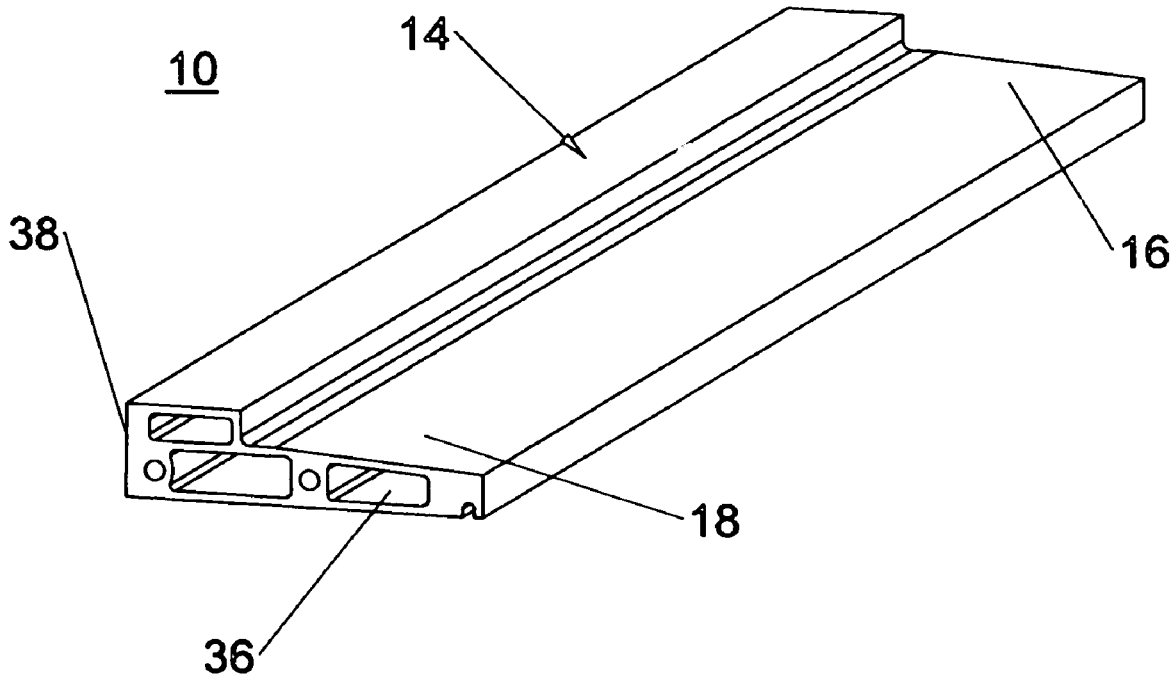
FIG. 3 is a perspective of a first embodiment of the elongated support rail of the support rail assembly.
Figure 4A:
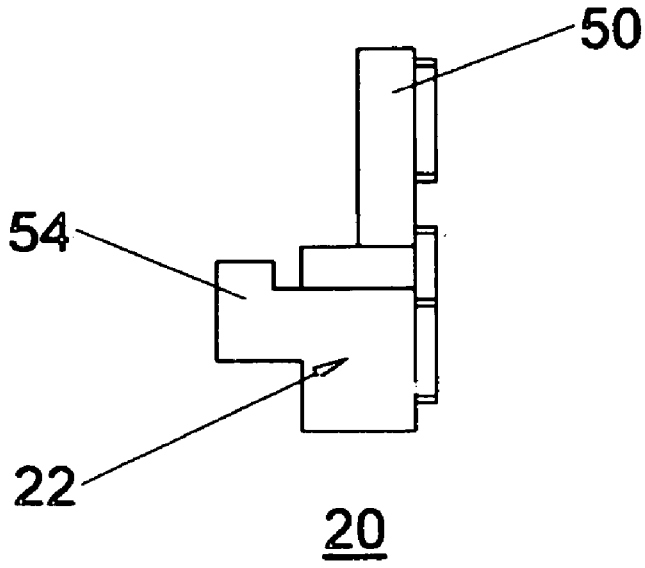
FIG. 4A is a plan view of the channel engaging block shown in FIG. 4.
Figure 4:
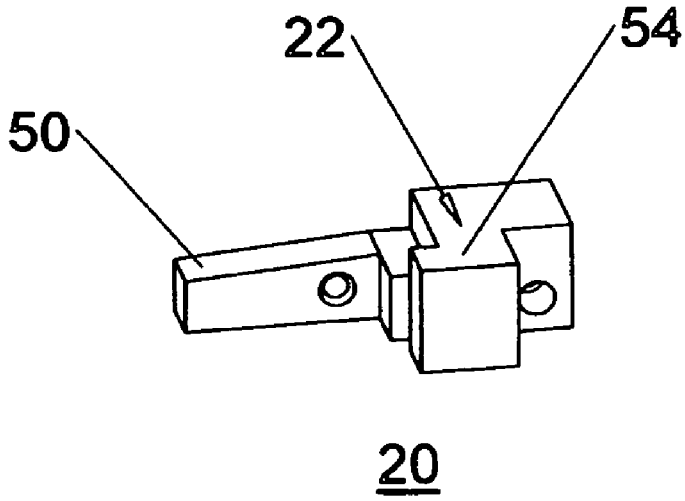
FIG. 4 is a perspective view of a channel engaging block for attachment to a first end of an elongated support rail.
Figure 5A:
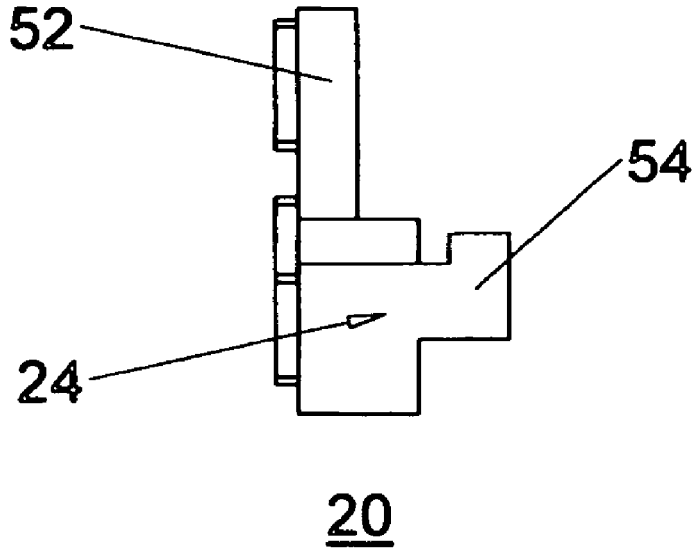
FIG. 5A is a plan view of the channel engaging block shown in FIG. 5.
Figure 5:
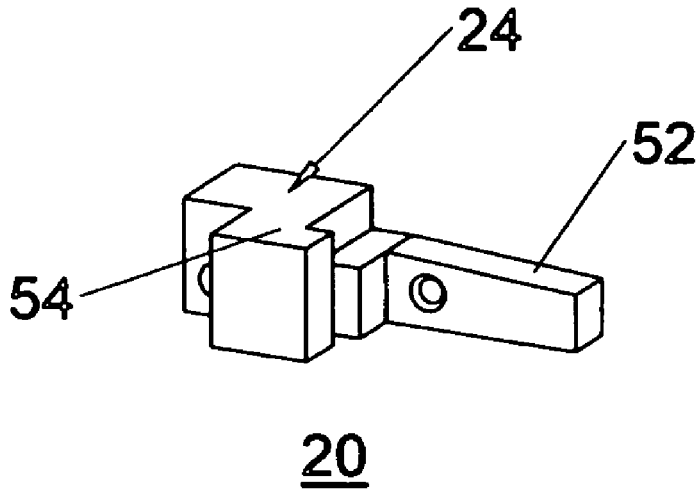
FIG. 5 shows a perspective view of a channel engaging block for attachment to a second end of the support rail, which is a mere image of that channel engaging block shown in FIG. 4.
Figure 6:
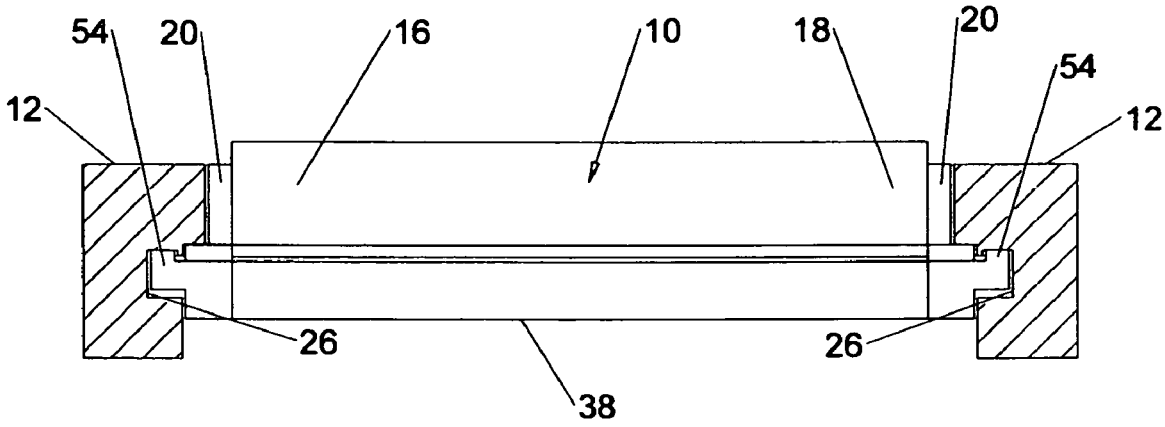
FIG. 6 is a plan view of the elongated support assembly of the present invention shown installed within a window frame which is represented in section.

Referring now to the drawings in detail and particularly to FIGS. 1 and 2, there is shown the present invention which comprises a support assembly 10 for insertion across a rectilinear window frame assembly 12 arranged within a wall 15. The support assembly 10 comprises an elongated rail 14 having a first end 16 and a second end 18, as best represented in FIG. 3. Each first or left end 16 and second or right end 18 preferably has a channel engaging block 20 thereon, as represented in FIG. 6. An exemplary left end block 22 is shown in FIGS. 4 and 4A, and an exemplary right end block 24 is shown in FIGS. 5 and 5A. Each channel engaging block 20 at each end of the support rail 16 and 18 is arranged to mate within a window sash channel 26 of the window frame assembly 12, as represented in FIGS. 1 and 6.

Figure 8:
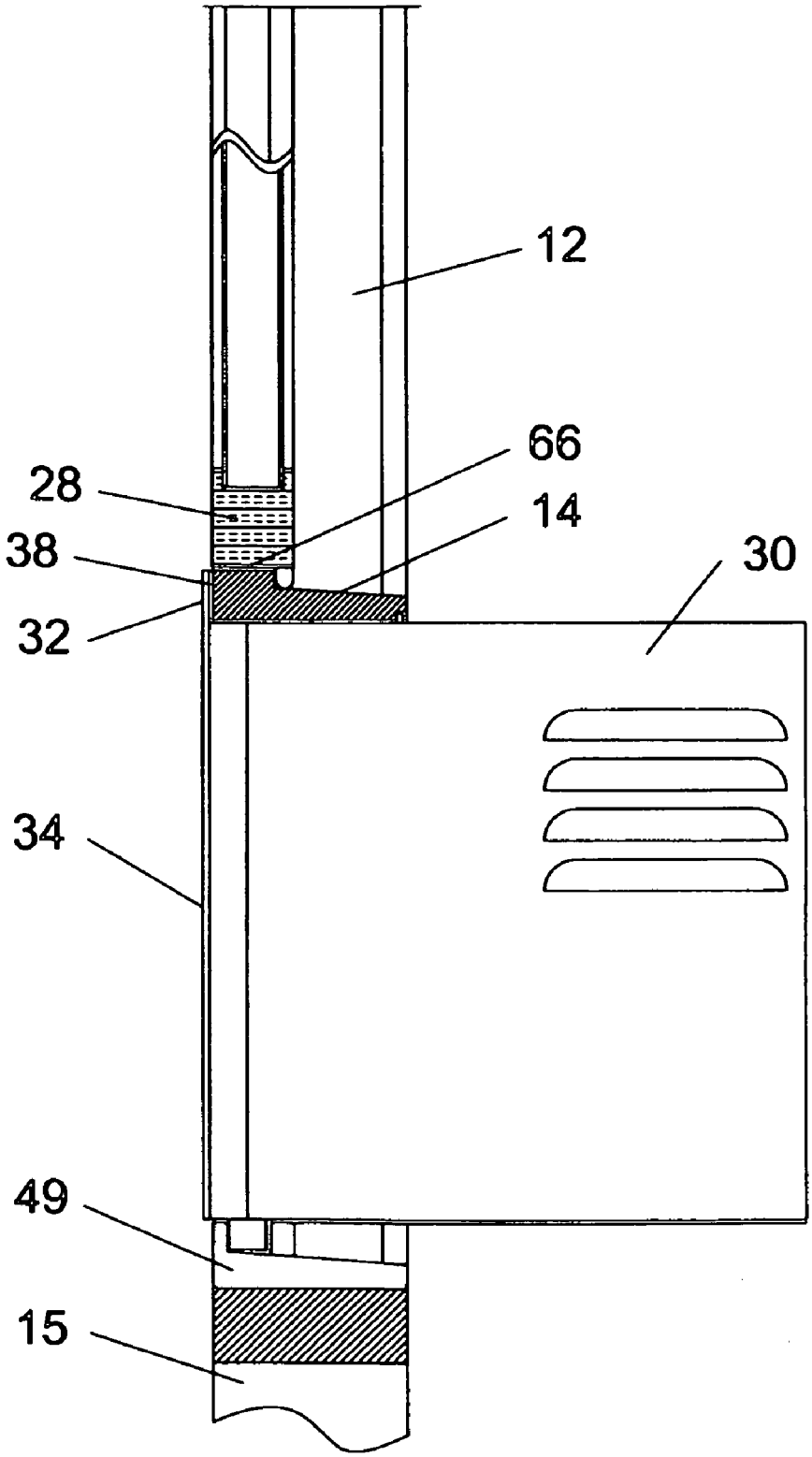
FIG. 8 is a side elevational view, with portions in section, of an air conditioner sitting within a window frame assembly, with a support rail engaged thereagainst, and a window sash lowered against the upper edge of that inventive support rail assembly.
Figure 9:
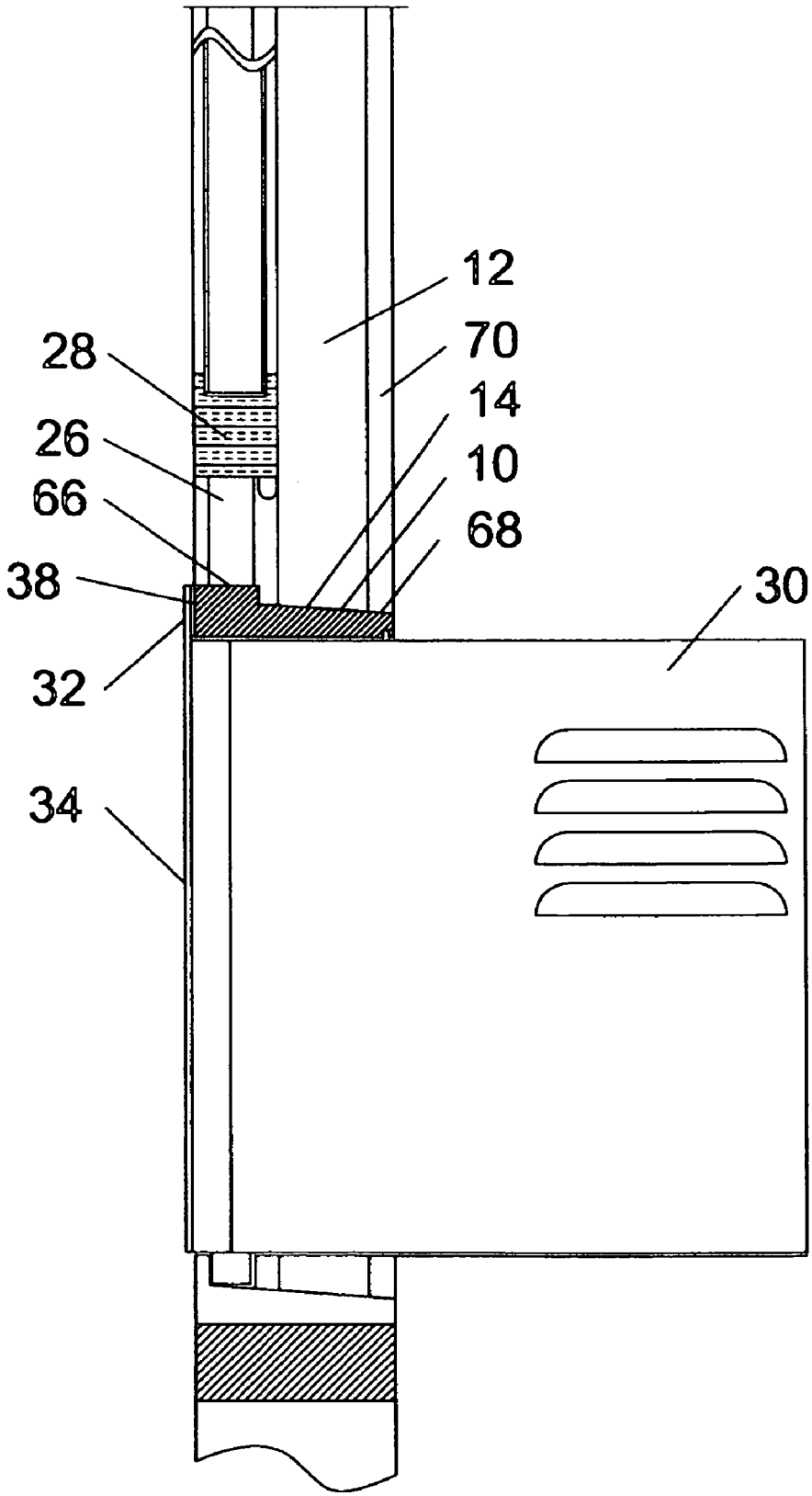
FIG. 9 is a view similar to that shown in FIG. 8, showing the air conditioner and elongated support rail arranged within a window frame assembly, with the window sash in its "open" orientation.

When for example, an air conditioning unit 30 is placed within a window frame assembly 12, the elongated support assembly 10 is placed so as to engage the upwardly directed flange 32 on the front upper edge (on the inside face 34) of the air conditioner 30, so as to take the place of the lower frame of the window sash 28 which would otherwise normally hold their air conditioner 30 in place within that window frame assembly 12, as represented in FIGS. 1, 8 and 9.

In a first embodiment of the elongated support assembly, the elongated support rail 14 is arranged having a first end 16 and a second end 18. The support rail 14 may for example, be extruded, as represented in FIG. 3, and has several block-receiving openings 36 extending there-through, and is thus opened at each end 16 and 18 thereof. The support rail assembly 10 has a front air conditioning flange engaging face 38 extending along its entire length, as represented in FIGS. 3, 6, 7, 8 and 9.

Figure 7:
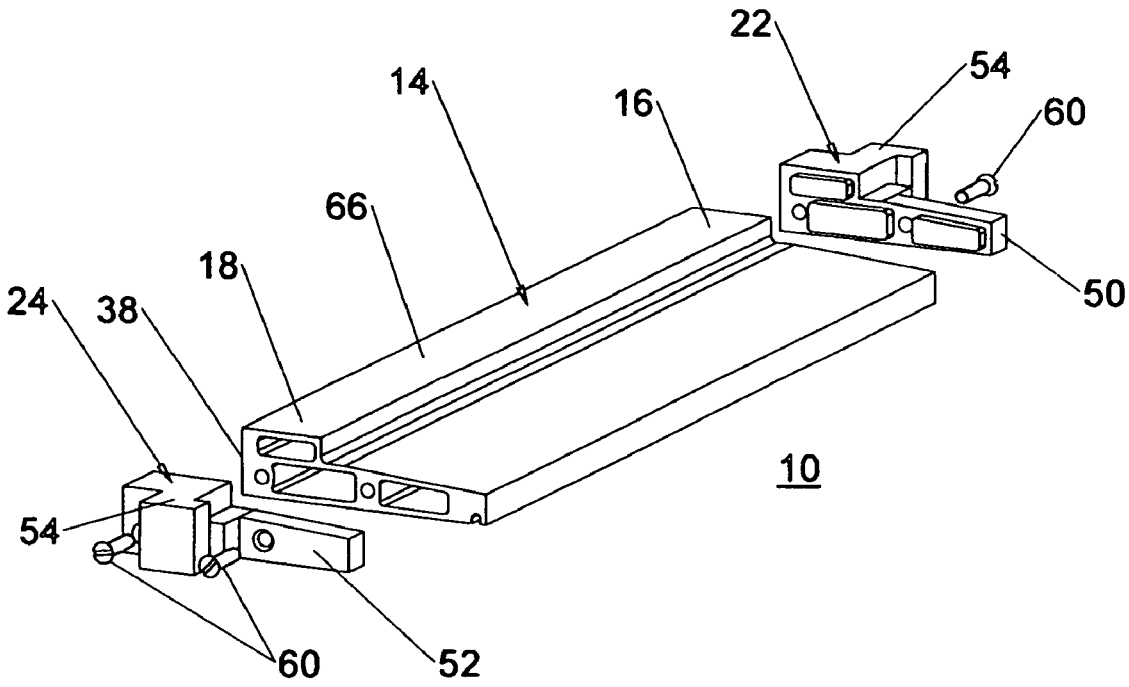
FIG. 7 is an exploded view, in perspective, of an elongated support assembly with a further disclosed attachment block arrangement therewith.

In this first preferred embodiment, a left and a right channel engaging block 22 and 24 are adapted to fit within their respective extruded openings 36 extending through the elongated support rail 14, and having a window framed channel engaging member 54 extending therefrom, as represented in FIG. 6. Such a left and right end channel engaging block 22 and 24 are arranged to be attached to their respective ends 16 and 18 of the elongated support rail 14, wherein the left end block 22, as shown in FIGS. 4 and 4A has a transversely directed rail side-engaging tab 50 and right end block 24 also has a transversely rail side- engaging tab 52 thereon, a shown in FIGS. 5 and 5A. The tabs 50 and 52 enable attachment means 60 help secure the blocks 20 (22 and 24) to their respective ends of the rail 14, as shown in FIG. 7. The left and right channel engaging blocks 22 and 24 on each respective end of the elongated support rail assembly 10 are each mirror images of one another. Each of those blocks 20, comprising the left 22 and right 24, has its window frame channel engaging tab 54 extending therefrom, which tabs 54 act to mate with the respective channels 26 in the sides of the window frame assembly 12, as shown in FIGS. 1 and 6.

In yet a further embodiment of the present invention, such an elongated support assembly 10 surprising the elongated support rail 14 and the engaging blocks 20 at each end thereof may be formed or molded as a single unitary member, as may be represented in FIG. 6, having such window channel engaging tabs 54 unitarily formed therewith.

In yet a still further preferred embodiment of the present invention, an elongated support rail 14 may have window channel engaging blocks 20 attached at each end 16 and 18 respectively, through a bolt or screw thread securement arrangement 60, avoiding the otherwise need for a large block-receiving opening 36 at each end thereof.

The air conditioning unit 30 bears its weight against the lower window sill 49, as shown in FIGS. 1 and 8, which sill 49 comprises the lower frame portion original window frame assembly 12. The elongated support rail assembly 10, acts as a "secondary" window sash or sill with its front face 38 thereof providing a resistive support to the torque of the heavy portable air conditioner 30 biased thereagairst by its flange 32 located on the upward edge of the inside-facing face of the air conditioner 30, as represented in FIGS. 1, 8 and 9. In such a supportive arrangement, the sash 28 of the window may rest against the upper edge 66 of the elongated rail support 14, as best represented in FIG. 8. In a further use thereof, that window sash 28 may be lifted, and the portable window engaging air conditioner 30 may still rest safely within the window frame assembly 12, as represented in FIGS. 1 and 9. A screen 70 of that window frame assembly 12 may rest upon the splash shield or upper outer portion 68 of the elongated rail 14. The sash 28 of that window may be raised to allow the portable air conditioner 30 to the inoperative during periods when it is not necessary, as is shown in FIG. 9.

Thus there has been shown a novel support for a portable air conditioner 30 to be disposed within a window frame assembly 12 by an elongated support rail 14 having a window frame channel engaging member 20 at each end thereof, to transfer the burden of the supporting of the air conditioner 30 into the channels 26 of the window frame itself, so as not to be supported and maintained by a window sash 28 lowered against the flange 32 of that air conditioner 30. Such an arrangement prevents the distortive "bowing" or bruising of that window sash 28 while permitting that window to be opened when desired.

The invention claimed is:

1. A method of supporting a portable air conditioner in a window frame assembly, said air conditioner having an elongated, upwardly extending flange along its inwardly facing face, said window frame assembly having a window sash which are slidable vertically in channels in the sides of said window frame assembly, said method comprising:

moving said window sash upwardly to make room for an air conditioner and an elongated rail assembly to be installed within said window frame assembly;

placing said elongated rail assembly having channel-engaging tabs on each end thereof into channels on each side of said window frame assembly;

placing said portable air conditioner within a lower portion of said opened window frame assembly; and maneuvering said flange on said upper front edge of said air conditioner into supportive abutment with a side of said elongated rail assembly, so as to eliminate any force on said window sash by said air conditioner.

2. The method as recited in claim 1 including:

moving said sash against and away from an upper surface of said rail without disturbing said air conditioner.

* * * * *